United States Patent [19]

Blumenthal

[11] 4,271,559

[45] Jun. 9, 1981

[54] TONER CLEAN-OFF HEAD

[75] Inventor: John Blumenthal, Wickliffe, Ohio

[73] Assignee: Gould Inc., Rolling Meadows, Ill.

[21] Appl. No.: 80,898

[22] Filed: Oct. 1, 1979

Related U.S. Application Data

[62] Division of Ser. No. 903,855, May 8, 1978, Pat. No. 4,198,923.

[51] Int. Cl.[3] ..... A47L 5/14

[52] U.S. Cl. ..... 15/308; 15/345; 118/652; 355/15

[58] Field of Search ..... 15/306 A, 308, 345, 15/346; 118/63, 652; 430/125; 355/15

[56] References Cited

U.S. PATENT DOCUMENTS

| | | | |
|---|---|---|---|
| 2,082,411 | 6/1937 | Merrill | 15/306 A |
| 3,654,659 | 4/1972 | Blumenthal | 15/306 A |
| 3,841,910 | 10/1974 | Baker | 15/345 X |
| 4,026,701 | 5/1977 | Till et al. | 355/15 X |
| 4,067,018 | 1/1978 | Pond | 118/652 X |

OTHER PUBLICATIONS

Sanders, K., *Air Wedge and Air Entry,* IBM Technical Disclosure Bulletin, vol. 19, No. 8, p. 3215, Jan. 1977.

*Primary Examiner*—Evan K. Lawrence
*Attorney, Agent, or Firm*—Edward E. Sachs; Barry L. Tummino

[57] ABSTRACT

A toner clean-off head utilizing a vacuum for removing liquid toner from a moving record medium having a latent electrostatic image thereon, in which the contact surface of the clean-off head is cylindrical so that the record medium easily conforms to ensure proper removal of the toner with a minimum of applied vacuum. A thin clean-off blade is positioned in a slot in the cylindrical contact surface so that the edge of the blade forms an element of the surface, and an inlet air passage and a toner exhaust passage in communication with vacuum means are defined on either side of the blade.

2 Claims, 2 Drawing Figures

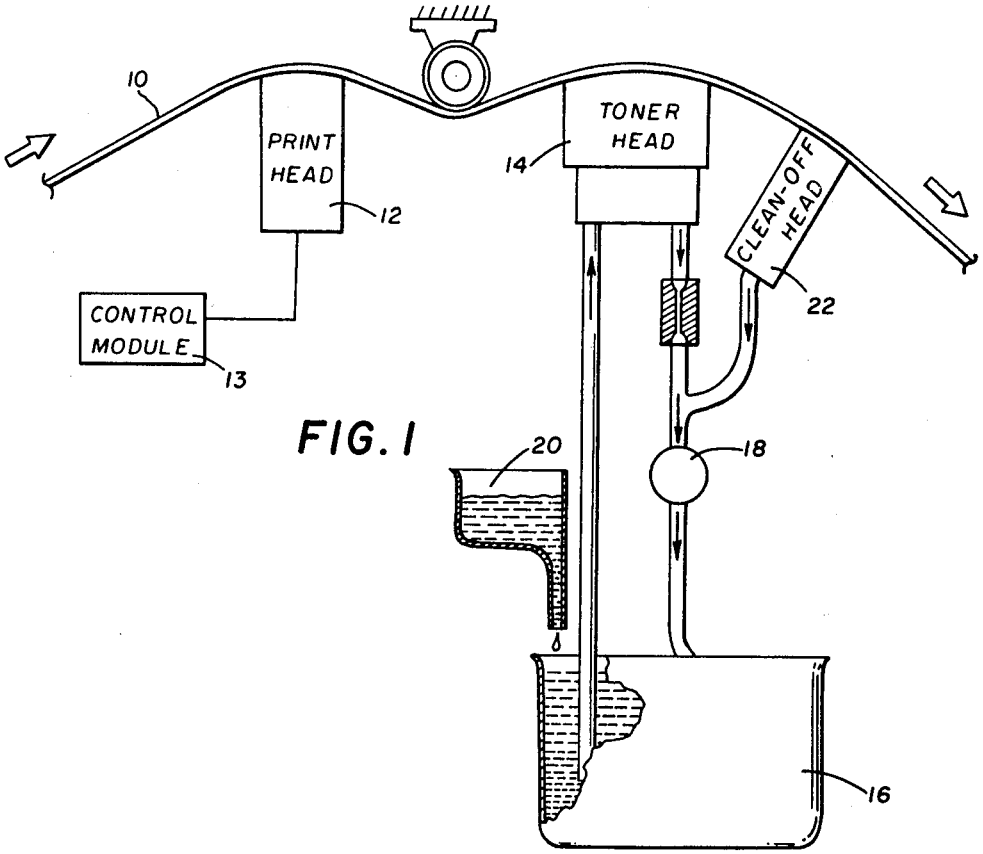
FIG. 1
FIG. 2
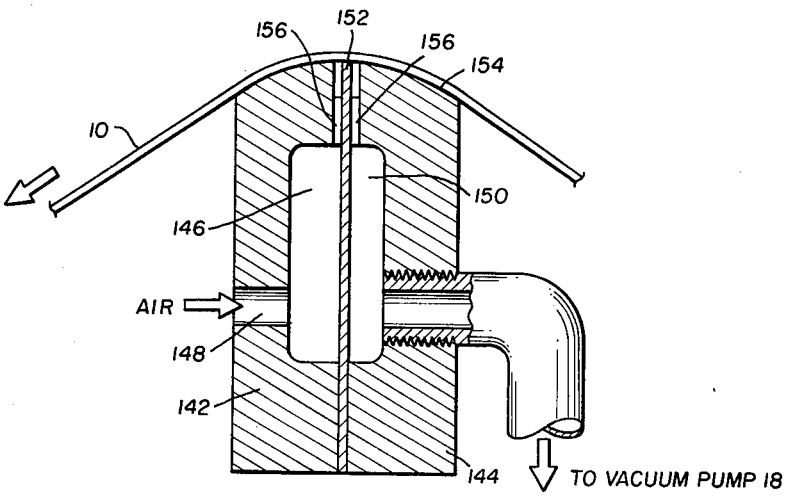

TONER CLEAN-OFF HEAD

This is a division of application Ser. No. 903,855, filed May 8, 1978, now U.S. Pat. No. 4,198,923.

BACKGROUND OF THE INVENTION

In the electrostatic printing and plotting, or imaging, arts, various systems have been developed over the years in which a latent image first is electrostatically imparted to a moving record medium and then is developed or toned by the application of a toning material which adheres to the electrostatically produced latent image. Both dry and liquid toners have been used and each has been found to have its own peculiar characteristics, advantages and problems.

Of particular interest with regard to the present application are those systems in which liquid toners are used.

Typically in liquid toned electrostatic systems, an excess of toner is applied to the record medium to ensure adequate development; then the excess is drawn away by some means and the record medium is allowed to dry. U.S. Pat. No. 3,654,659, issued to John Blumenthal, the present applicant, and also assigned to the assignee of the present application, discloses a type of liquid toner clean-off system for high speed operation. The wet record medium is drawn past an elongated suction opening which is just upstream of a narrow land lying in the same plane as the suction opening. Air is drawn over the land when suction is applied to the suction opening, thereby skimming excess toner from the record medium. While this technique has achieved a significant measure of success, the flat configuration of the clean-off head makes effective sealing with the record medium difficult, thereby requiring the use of rather high vacuum, as in the case of the toning head previously mentioned.

Those skilled in the art will appreciate that a need has existed for some time for a reliable toner clean-off head which will not rely on the use of high vacuum to ensure proper engagement between the head and the record medium. The present invention seeks to satisfy these needs.

SUMMARY OF THE INVENTION

An object of the invention is to provide an improved liquid toner clean-off head for use in electrostatic printers and plotters, in which a substantially smaller pressure differential will provide proper engagement between the record medium and the toner clean-off head.

Another object of the invention is to provide a toner clean-off head which is less susceptible to abrasive wear and also less prone to changes in operating characteristics as wear occurs.

The above objects are given only by way of example. Thus, other desirable objects and advantages inherently achieved by the disclosed invention may become apparent to those skilled in the art. Nonetheless, the scope of the invention is to be limited only by the appended claims.

The invention concerns a toner clean-off head utilizing a vacuum for removal of the toner, the head having a cylindrical contact surface which is self-regenerating under normal abrasive wear conditions and to which the record medium easily conforms to ensure proper removal of toner with a minimum of applied vacuum. Good toner clean off results have been achieved with an applied vacuum as low as 90 mm of mercury (3.5 inches), with some improvement in effectiveness up to about 150 mm of mercury (6 inches).

BRIEF DESCRIPTION OF THE DRAWINGS

FIG. 1 shows a schematic arrangement of an electrostatic printer or plotter embodying with a toning head and the toner clean-off head according to the invention;

FIG. 2 illustrates an embodiment of the toner clean-off head according to the invention.

DESCRIPTION OF THE PREFERRED EMBODIMENTS

There follows a detailed description of the preferred embodiments of the invention, reference being made to the drawings in which like reference numerals identify like elements of structure in each of the several Figures.

FIG. 1 illustrates schematically the general layout of an electrostatic printer-plotter or similar imaging system embodying the invention. A record medium 10, such as a suitably treated paper, is drawn from a source, not shown, over an electrostatic printer head 12, which may be of the type disclosed in U.S. Pat. No. 3,611,419, granted to the present applicant and also assigned to the assignee of this application. Printer head 12 induces on record medium 10 a latent electrostatic image of the intelligence to be recorded, in response to electrical signals from control module 13. Then, record medium 12 is drawn over a curved toner head 14 according to the present invention so that the latent image is developed. Toner liquid is drawn through toner head 14 from a reservoir 16 by means such as a vacuum pump 18. Partially depleted toner is then returned to reservoir 16 where it may be replenished, as indicated schematically at 20. Following toning, the wet, developed record medium is drawn over a curved clean-off head 22 according to the invention, which removes the excess toner by applying suction from pump 18. The essentially dry, developed record medium is then drawn away and made accessible for tearing off, cutting off, winding up, folding or the like, by means not shown.

FIG. 2 shows a vertical section view through an embodiment of toner clean-off head 22. Housing halves 142,144 define an air inlet plenum 146 vented to atmosphere via passage 148; and an air and toner outlet plenum 150 connected to a vacuum pump 18 via a suitable conduit. Plenums 146 and 150 extend across head 22 and are separated by a clean-off blade 152 which extends upwardly through and is flush with the curved upper surface 154 of the clean-off head. Preferably surface 154 is cylindrically shaped as in the case of the toner heads previously discussed, with a radius of curvature of 1.25 to 2.5 cm. Clean-off blade 152 typically is about 0.25 mm (0.010 inch) thick and passes through to surface 154 with 0.25 mm (0.010 inch) flow passages on either side. A plurality of opposing pads 156 rigidly support blade 152 near surface 154. In operation, the wet paper is drawn over the clean-off head in the direction indicated by the arrow. The curvature of surface 154 ensures proper sealing. Air drawn in through passage 148 rushes over the upper edge of blade 152, and entrains excess toner from the surface of the paper. The air and excess toner are then drawn away through outlet plenum 150 and returned to reservoir 16.

Having described my invention in sufficient detail to enable those skilled in the art to make and use it, I claim:

1. An improved toner clean-off head for removing excess liquid toner from the surface of a moving record medium bearing an electrostatic image which has been developed by the application of liquid toner, comprising:

a housing having a cylindrical upper surface and an interior volume, said record medium being drawn over said cylindrical upper surface;

a slot in said upper surface extending into said interior volume;

a thin clean-off blade positioned in said slot so that the upper edge of said blade essentially forms an element of said cylindrical upper surface and that a first and a second flow passage are defined on either side of said blade; and means for dividing said interior volume into an air inlet plenun and a toner exhaust plenum, said air inlet plenum being vented to the atmosphere and in communication with said first flow passage, said exhaust plenum being in communication with a vacuum means and with said second flow passage, such that air is drawn into said inlet plenum, through said first flow passage, over the upper edge of said clean-off blade to entrain excess liquid toner from said record medium, through said second flow passage and out said exhaust plenum, said record medium forming a seal against said cylindrical upper surface.

2. An improved toner clean-off head according to claim 1, wherein said dividing means comprises an extension of said clean-off blade into said interior volume.

* * * * *